US012139298B2

(12) United States Patent
Yourist et al.

(10) Patent No.: US 12,139,298 B2
(45) **Date of Patent: *Nov. 12, 2024**

(54) HOT-FILLABLE PLASTIC CONTAINER

(71) Applicant: CO2PAC LIMITED, Mt Eden (NZ)

(72) Inventors: Sheldon E. Yourist, York, PA (US); Raymond A. Pritchett, Jr., Mt. Wolf, PA (US)

(73) Assignee: CO2PAC LIMITED, Auckland (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 18/134,343

(22) Filed: Apr. 13, 2023

(65) Prior Publication Data

US 2023/0249867 A1 Aug. 10, 2023

Related U.S. Application Data

(63) Continuation of application No. 17/139,719, filed on Dec. 31, 2020, now Pat. No. 11,661,229, which is a (Continued)

(51) Int. Cl.
*B65D 90/02* (2019.01)
*B65D 1/02* (2006.01)

(Continued)

(52) U.S. Cl.
CPC ..... *B65D 1/42* (2013.01); *B65D 1/0207* (2013.01); *B65D 1/0276* (2013.01); *B65D 85/72* (2013.01);

(Continued)

(58) Field of Classification Search
CPC ..... B65D 1/42; B65D 1/0207; B65D 1/0276; B65D 79/005; B65D 85/72; B65D 2501/0081

(Continued)

(56) References Cited

U.S. PATENT DOCUMENTS 3,536,500 A * 10/1970 Cleereman ..... B65D 1/0223 426/106
5,054,632 A 10/1991 Alberghini et al.

(Continued)

OTHER PUBLICATIONS

International Search Report and Written Opinion dated Mar. 20, 2018 received in International Application No. PCT/US2017/68646).

*Primary Examiner* — Gideon R Weinerth
(74) *Attorney, Agent, or Firm* — Armstrong Teasdale LLP

(57) ABSTRACT

Plastic container comprises a container body having a bottom portion, a sidewall portion and an upper portion, with a chamber defined therein. The bottom portion includes a support surface and a variable dynamic base portion. The sidewall portion includes a lower circumferential groove ring, an upper circumferential groove ring, and a pair of longitudinal grooves extending longitudinally therebetween to define a front sidewall segment and a rear sidewall segment. The rear sidewall segment comprises a waist groove extending circumferentially between the pair of longitudinal grooves to define an upper rear sidewall segment and a lower rear sidewall segment, wherein one of the upper rear sidewall segment or the lower rear sidewall segment includes two vacuum panels with a rigid longitudinal support therebetween.

2 Claims, 22 Drawing Sheets

Related U.S. Application Data continuation of application No. 15/856,418, filed on Dec. 28, 2017, now Pat. No. 10,899,493.

(60) Provisional application No. 62/440,267, filed on Dec. 29, 2016.

(51) Int. Cl.
*B65D 1/42* (2006.01)
*B65D 79/00* (2006.01)
*B65D 85/72* (2006.01)

(52) U.S. Cl.
CPC .... *B65D 79/005* (2013.01); *B65D 2501/0081* (2013.01)

(58) Field of Classification Search
USPC ..... 220/604
See application file for complete search history.

(56) References Cited

U.S. PATENT DOCUMENTS 5,598,941 A 2/1997 Semersky et al.
5,704,503 A 1/1998 Krishnakumar et al.
5,971,184 A 10/1999 Krishnakumar et al.
D482,976 S 12/2003 Melrose
6,932,228 B1 * 8/2005 Darr ..... B65D 1/0276 206/509
7,080,747 B2 7/2006 Lane et al.
D579,780 S 11/2008 Lepoitevin
D653,957 S * 2/2012 Yourist ..... D9/557
8,328,033 B2 12/2012 Mast
8,739,995 B2 6/2014 Sasaki et al.
9,296,539 B2 3/2016 Wright et al.
9,302,840 B2 4/2016 Boukobza
9,707,711 B2 7/2017 Trude et al.
9,862,518 B2 1/2018 Gill et al.
9,981,768 B1 * 5/2018 Palmer ..... B65D 1/42
D837,656 S 1/2019 Mora
10,899,493 B2 1/2021 Yourist et al.
D926,039 S 7/2021 Yourist
D926,041 S 7/2021 Huls et al.
11,661,229 B2 * 5/2023 Yourist ..... B65D 85/72 220/675
2001/0035392 A1 * 11/2001 Ota ..... B65D 1/0223 215/381
2004/0206718 A1 10/2004 Wetherell, Jr. et al.
2005/0067369 A1 3/2005 Trude
2005/0269284 A1 12/2005 Pedmo et al.
2006/0255005 A1 * 11/2006 Melrose ..... B65D 1/46 215/381
2007/0039917 A1 * 2/2007 Yourist ..... B65D 79/0084 215/382
2007/0075032 A1 4/2007 Kelley et al.
2008/0041811 A1 2/2008 Stowitts
2008/0073315 A1 * 3/2008 Hermel ..... B65D 1/0223 215/379
2008/0245762 A1 * 10/2008 Matsuoka ..... B65D 1/0223 215/383
2008/0257856 A1 10/2008 Melrose et al.
2009/0057263 A1 3/2009 Barker et al.
2009/0095702 A1 4/2009 Ungrady et al.
2009/0294399 A1 * 12/2009 Pritchett, Jr. ..... B65D 79/0084 215/381
2009/0321384 A1 12/2009 Zhang et al.
2010/0006580 A1 1/2010 Boukobza
2010/0116778 A1 5/2010 Melrose
2010/0181280 A1 7/2010 Howell et al.
2010/0219154 A1 9/2010 Mooney
2011/0079574 A1 * 4/2011 Wurster ..... B65D 1/42 215/383
2011/0147392 A1 6/2011 Trude et al.
2012/0061410 A1 3/2012 Kamineni et al.
2012/0097635 A1 4/2012 Yourist et al.
2012/0160857 A1 6/2012 Melrose et al.
2012/0205341 A1 8/2012 Mast et al.
2012/0205342 A1 8/2012 Philip et al.
2013/0008913 A1 1/2013 Boukobza
2013/0186848 A1 7/2013 Pasutanon et al.
2013/0213979 A1 * 8/2013 Pedmo ..... B65D 1/0276 220/600
2014/0183202 A1 7/2014 Hanan
2015/0251810 A1 * 9/2015 Glaser ..... B65D 23/102 215/382
2016/0221739 A1 * 8/2016 Caboni ..... B65D 1/0223
2016/0236845 A1 8/2016 Boukobza
2017/0225863 A1 8/2017 Lohmeier et al.
2017/0349349 A1 12/2017 Stelzer et al.
2018/0186500 A1 7/2018 Yourist et al.
2020/0002044 A1 1/2020 Sugizaki et al.
2020/0062439 A1 2/2020 Klok et al.
2020/0095010 A1 * 3/2020 Kira ..... B65D 1/0223
2020/0198826 A1 * 6/2020 Xoy ..... B65D 1/0207
2021/0139185 A1 * 5/2021 Tanaka ..... B65D 1/0207
2022/0242642 A1 * 8/2022 Godet ..... B65D 79/0081
2022/0396408 A1 12/2022 Pritchett, Jr. et al.

* cited by examiner

HOT-FILLABLE PLASTIC CONTAINER

CROSS-REFERENCE TO RELATED APPLICATIONS

This application is a continuation of U.S. patent application Ser. No. 17/139,719, filed Dec. 31, 2020, which, in turn, is a continuation of U.S. patent application Ser. No. 15/856,418, filed Dec. 28, 2017, now U.S. Pat. No. 10,899,493, which claims the benefit of priority under 35 U.S.C. § 119(3) to U.S. Provisional Patent Application No. 62/440,267, filed Dec. 29, 2016, the disclosures of which are incorporated herein by reference in their entireties.

BACKGROUND

Technical Field

The disclosed subject matter relates to plastic containers having unique features to sustain hot-filling processes and related pressure differential resulting therefrom.

Description of Related Art

Hot-filling is a process of choice for the packaging or bottling of many juice and beverage products. Hot-filling process generally involves filling a suitable container with a beverage or liquid product, such as juices, sauces, teas, flavored waters, nectars, isotonic drinks and sports drinks etc., at a temperature suitable for sterilization, and then sealing and cooling the container to room temperature or below for distribution. During the processes of hot filling, sealing, and cooling, the containers are subject to different thermal and pressure differential scenarios that can cause deformation if made of plastic, which may render the containers visually unappealing or non-functional. Certain containers include functional improvements, such as vacuum panels and bottle bases to accommodate these different thermal and pressure differential scenarios and minimize or eliminate unwanted deformation, making the package both visually appealing and functional for downstream situations.

The consumer beverage market is extremely competitive. Packages that are unique in the market, such as asymmetrical bottle designs, can aesthetically distinguish the products in the marketplace and are highly desirable by manufacturers. However, asymmetrical bottle designs create unique challenges for hot-filling processes. Conventional hot-fill plastic containers often have sidewall features that are substantially symmetrical about a longitudinal axis. This symmetrical design prevents undesirable tilting or lateral deflection of the container when subject to the thermal and pressure differential conditions associated with the hot-filling processes. A container having asymmetrical sidewall will stress or strain non-uniformly about the sidewall of the container at low pressure differential, and continue to distort the shape as the pressure differential increases, such as when vacuum increases during cooling. As a result, the introduction of stylized container designs into the hot-fill beverage market has been frustrated by this non-uniform distortion issue.

There thus remains a need for a commercially satisfactory asymmetrical plastic container that resists or provides compensation against distortion under hot-filling process.

SUMMARY

The purpose and advantages of the disclosed subject matter will be set forth in and are apparent from the description that follows, as well as will be learned by practice of the disclosed subject matter. Additional advantages of the disclosed subject matter will be realized and attained by the subject matter particularly pointed out in the written description and claims hereof, as well as from the appended drawings.

To achieve these and other advantages and in accordance with the purpose of the disclosed subject matter, as embodied and broadly described, the disclosed subject matter includes a hot-fillable plastic container comprising a container body having a bottom portion, a sidewall portion and an upper portion. The container body has a chamber defined therein. The container body further comprises a finish portion extending from the upper portion and defines a mouth in fluid communication with the chamber. The bottom portion includes a support surface and a variable dynamic base portion configured to deflect in response to a pressure differential between the chamber and an exterior of the container body. The sidewall portion includes a lower circumferential groove ring and an upper circumferential groove ring, and further includes a pair of longitudinal grooves extending longitudinally between the lower and upper circumferential groove rings to define a front sidewall segment on a front side of the sidewall portion between the upper and lower circumferential groove rings and a rear sidewall segment on a rear side of the sidewall portion between the upper and lower circumferential groove rings. The rear sidewall segment comprises a waist groove extending circumferentially between the pair of longitudinal grooves to define an upper rear sidewall segment between the waist groove and the upper circumferential groove ring, and a lower rear sidewall segment between the waist groove and the lower circumferential groove ring, wherein one of the upper rear sidewall segment or the lower rear sidewall segment includes at least one vacuum panel configured to deflect in response to the pressure differential between the chamber and the exterior of the container body. The waist groove can extend about a circumference of about 65% to about 75% of a diameter of the waist groove.

As embodied herein, each of the longitudinal grooves can connect with the lower circumferential groove ring and the upper circumferential groove ring. The front sidewall segment thus can be a front rigid panel bordered by the lower circumferential groove ring, the upper circumferential groove ring and the pair of longitudinal grooves. The front rigid panel can further include a plurality of circumferentially-extending ribs.

In addition, each of the longitudinal grooves can be nonlinear. The hot-fillable plastic container can further comprise a stiffening bead along at least a portion of a length of each longitudinal groove. The stiffening bead can extend from a lower end of each longitudinal groove to about ⅔ of a height of the hot fillable plastic container. The stiffening bead can be disposed along a rear edge of each longitudinal groove.

As embodied herein, the front sidewall segment can have a bow-tie shape defined between the pair of longitudinal grooves, with a maximum circumferential width proximate each of the lower and upper circumferential groove rings and a minimum circumferential width aligned longitudinally along a height of the sidewall portion with the waist groove.

In accordance with another aspect of the disclosed subject matter, the lower rear sidewall segment can include the at least one vacuum panel. Particularly, the lower rear sidewall segment can include two vacuum panels. The lower rear sidewall segment can further include a rigid longitudinal support between the two vacuum panels. Each vacuum panel can be angled inwardly toward the chamber relative to a vertical reference plane perpendicular to the support surface. For example, each vacuum panel can be recessed relative to an outer surface of the rear sidewall segment, wherein an upper recessed depth along an upper edge of the vacuum panel is greater than a lower recessed depth along a lower edge of the vacuum panel.

In accordance with another aspect of the disclosed subject matter, the rigid longitudinal support can be a rigid support panel having a border groove along an edge thereof, wherein the border groove can connect with the lower circumferential groove ring. The rigid support panel can include a plurality of circumferentially-extending ribs. The rigid support panel can have a partial frustoconical shape tapering inwardly toward the waist groove, and/or the upper rear sidewall segment can have a partial frustoconical or bowl shape, tapering inwardly toward the waist groove.

As embodied herein, the lower circumferential groove ring can have a width W1 and depth D1 in side view, and an outer radius R1 in plan view, wherein the ratio of the width W1 to the outer radius R1 can range between about 0.07 to about 0.22, and the ratio of the depth D1 to the outer radius R1 can range between about 0.04 to about 0.18. The upper circumferential groove ring can have a width W2 and depth D2 in side view, and an outer radius R2 in plan view, wherein the ratio of the width W2 to the outer radius R2 can range between about 0.07 to about 0.22, and the ratio of the depth D2 to the outer radius R2 can range between about 0.04 to about 0.18. The waist groove can have a width W3 and depth D3 in side view, and an inside radius R3 in plan view, wherein the ratio of the width W3 to the inside radius R3 can range between about 0.15 to about 0.46, and the ratio of the depth D3 to the inside radius R3 can range between about 0.10 to about 0.30. The longitudinal groove can have a width W4 and a depth D4 in plan view, and the front sidewall segment can have an outer radius R4 in plan view, wherein the ratio of the width W4 to the outer radius R4 can range between about 0.07 to about 0.18, and the ratio of the depth D4 to the outer radius R4 can range between about 0.02 to about 0.14.

BRIEF DESCRIPTION OF THE DRAWINGS

The subject matter of the application will be more readily understood from the following detailed description when read in conjunction with the accompanying drawings, in which:

FIGS. 8A-8D are graphical representations of a finite element analysis of an exemplary embodiment of the hot-fillable plastic container of FIG. 1A in accordance with the disclosed subject matter, wherein FIG. 8A is a schematic right side view of the exemplary embodiment, FIGS. 8B-8D are a series views of the container with graphical depictions of deformation formed in the plastic container as a result of a conventional hot-filling process, wherein FIG. 8B is a front view, FIG. 8C is a right side view, and FIG. 8D is a bottom view.

DETAILED DESCRIPTION

Figure 1A:
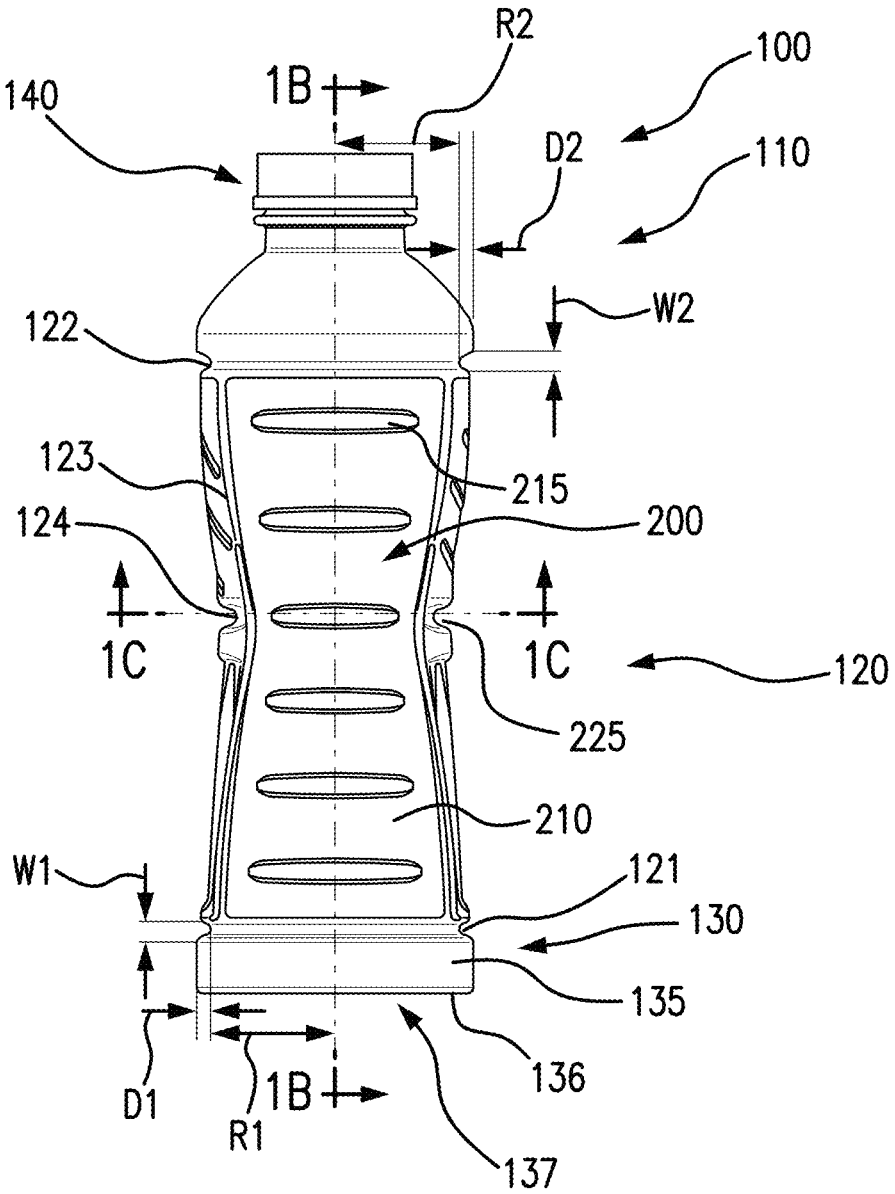
FIG. 1A is a front view of an exemplary hot-fillable plastic container in accordance with the disclosed subject matter.

Reference will now be made in detail to embodiments of the disclosed subject matter, an example of which is illustrated in the accompanying drawings. The disclosed subject matter will be described in conjunction with the detailed description of the system.

Plastic containers disclosed herein can be used in hot-filling applications for packaging a wide variety of fluid and viscous beverage or liquid products, such as juices, sauces, teas, flavored waters, nectars, isotonic drinks and sports drinks etc. The plastic containers disclosed herein are configured to accommodate an increase in internal container pressure differential when the sealed containers are subject to thermal treatment, and capable of accommodating vacuum during cool down. The unique configuration of the disclosed plastic containers incorporates a number of features that collectively control unwanted deformation during hot-filling processes. Furthermore, the plastic containers disclosed herein have unique asymmetrical designs for hot-fill beverage and food markets.

In accordance with the disclosed subject matter, a plastic container for hot-filling processes is provided. The hot-fillable plastic container comprises a container body having a bottom portion, a sidewall portion and an upper portion. The container body has a chamber defined therein. The container body further comprises a finish portion extending from the upper portion and defines a mouth in fluid communication with the chamber. The bottom portion includes a support surface and a variable dynamic base portion configured to deflect in response to a pressure differential between the chamber and an exterior of the container body. The sidewall portion includes a lower circumferential groove ring and an upper circumferential groove ring, and further includes a pair of longitudinal grooves extending longitudinally between the lower and upper circumferential groove rings to define a front sidewall segment on a front side of the sidewall portion between the upper and lower circumferential groove rings and a rear sidewall segment on a rear side of the sidewall portion between the upper and lower circumferential groove rings. The rear sidewall segment comprises a waist groove extending circumferentially between the pair of longitudinal grooves to define an upper rear sidewall segment between the waist groove and the upper circumferential groove ring, and a lower rear sidewall segment between the waist groove and the lower circumferential groove ring, wherein one of the upper rear sidewall segment or the lower rear sidewall segment includes at least one vacuum panel configured to deflect in response to the pressure differential between the chamber and the exterior of the container body.

The accompanying figures, where like reference numerals refer to identical or functionally similar elements throughout the separate views, serve to further illustrate various embodiments and to explain various principles and advantages all in accordance with the disclosed subject matter. Hence, features depicted in the accompanying figures support corresponding features and combinations thereof of the claimed subject matter.

Referring now to an exemplary embodiment as depicted in FIGS. 1A, for purpose of illustration and not limitation, a hot-fillable plastic container comprises a container body 100 having a bottom portion 130, a sidewall portion 120 and an upper portion 110. The container body thus defines a chamber therein for containing liquid products or the like. Additionally, and as illustrated in FIGS. 1A, for example and not limitation, the container body 100 includes a finish portion 140 extending from the upper portion 110 and defining a mouth in fluid communication with the chamber. The finish portion can have a variety of convention configurations, and can include a fastener, such as a thread or flange, for engaging a cap, as well as orientation and capping features as known in the art. Angular design elements on the upper portion 110 of the plastic container can be refined to work in harmony with other portions of the plastic container.

Figure 1B:
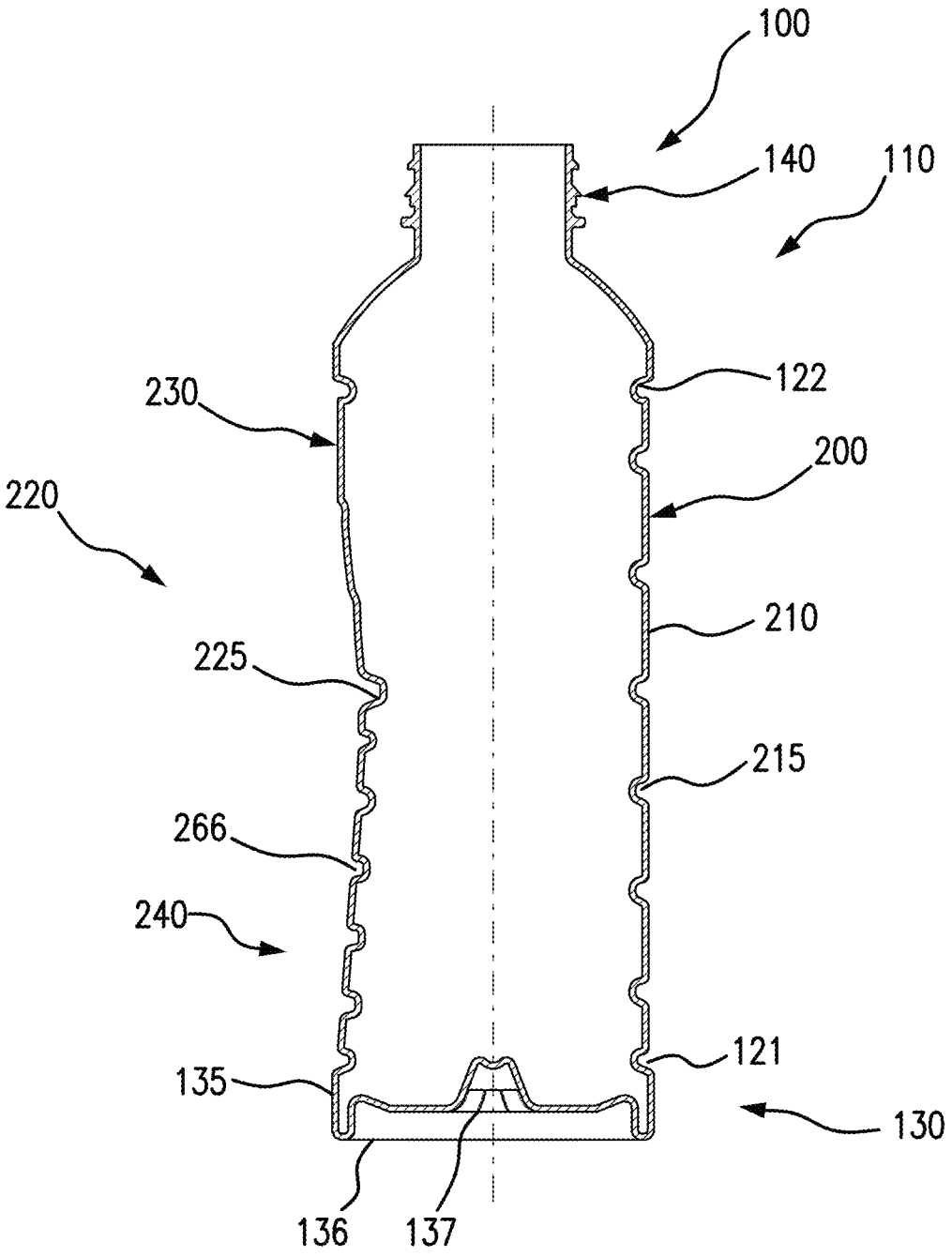
FIG. 1B is a cross-sectional side view taken along the line 1B-1B in FIG. 1A.
Figure 4A:
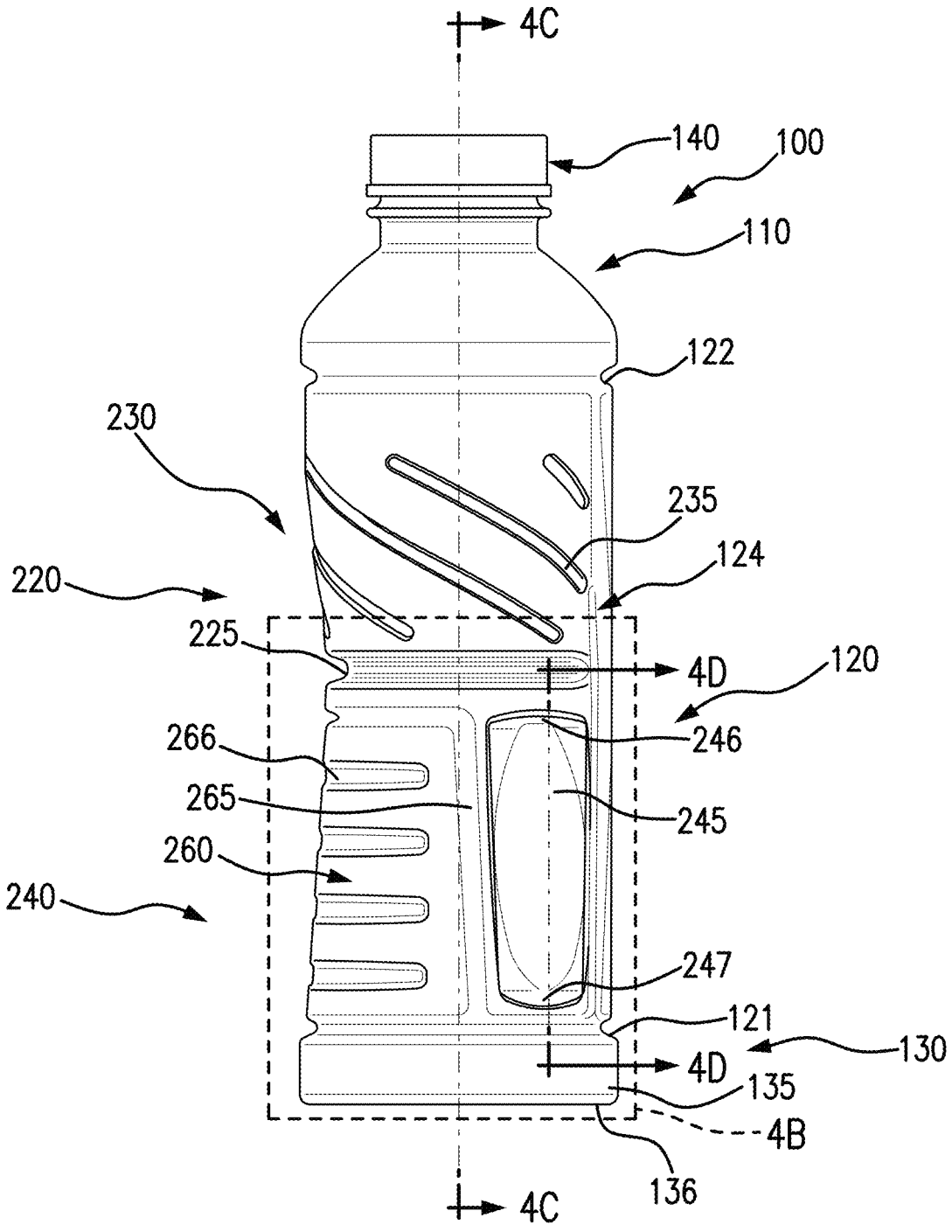
FIG. 4A is a rear-left view of the plastic container illustrated in FIG. 1A.
Figure 4B:
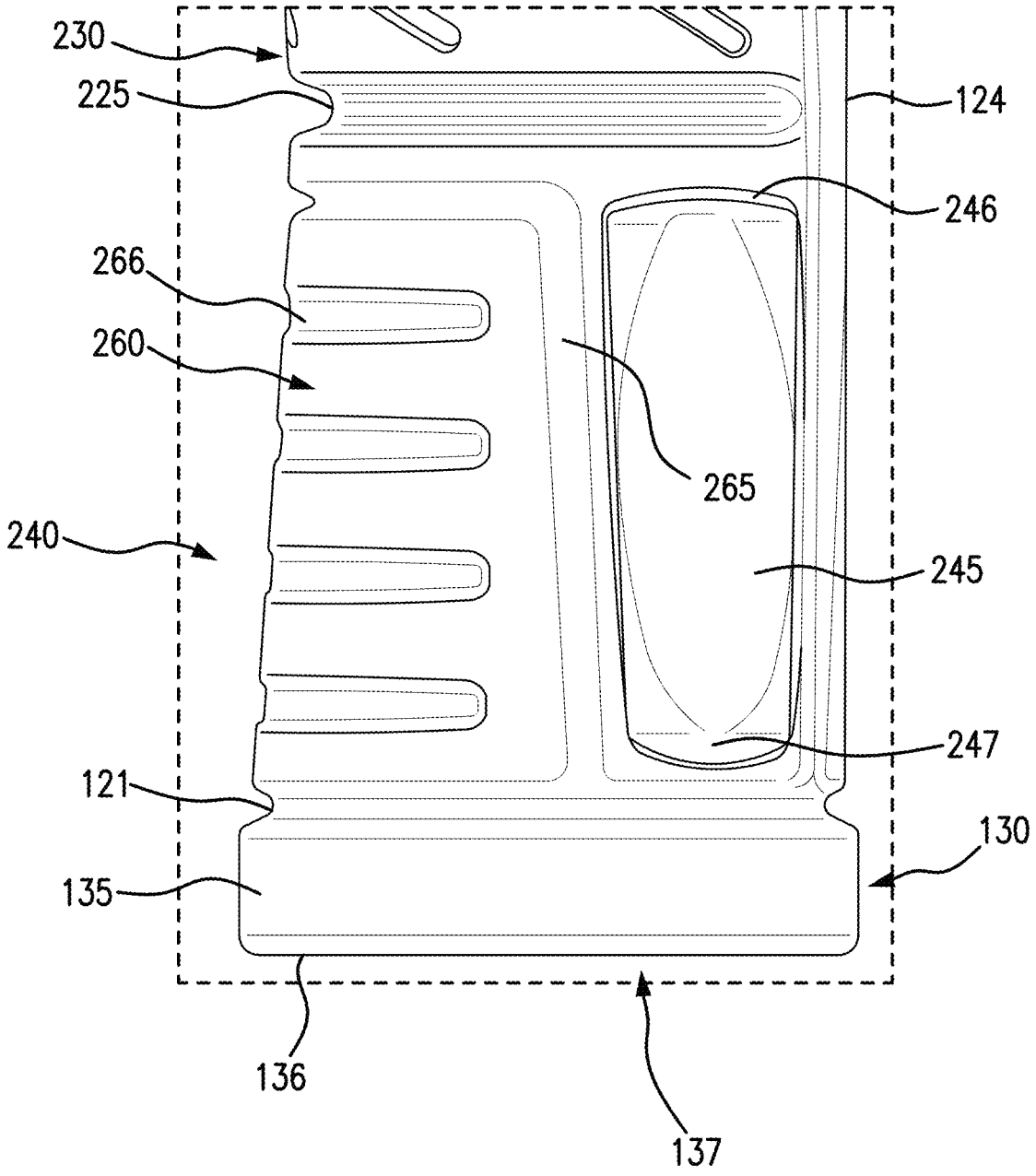
FIG. 4B is an enlarged detail view of the vacuum panel and longitudinal support of FIG. 4A.
Figure 4C:
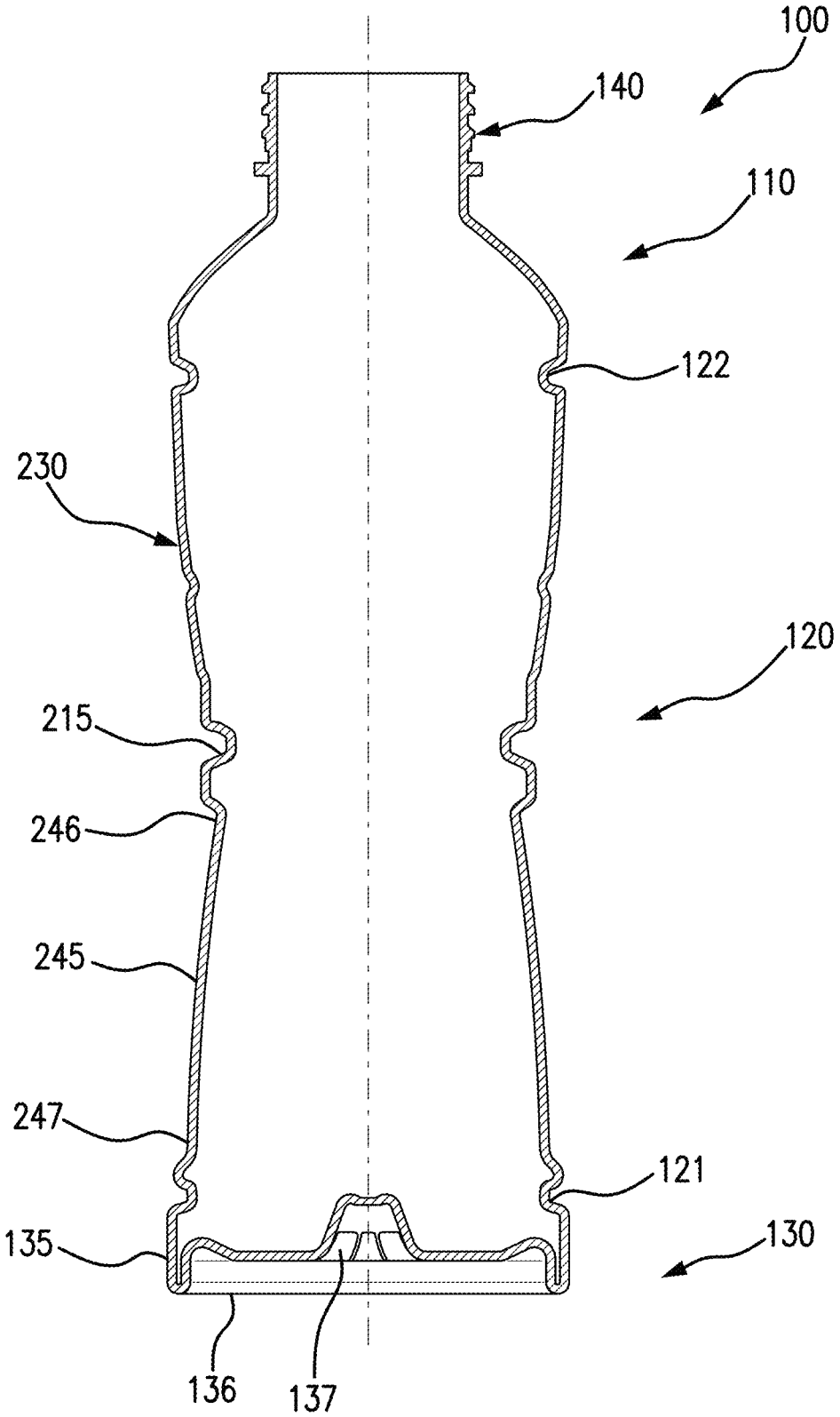
FIG. 4C is a cross-sectional side view of a plastic container taken along the line 4C-4C in FIG. 4A.
Figure 7:
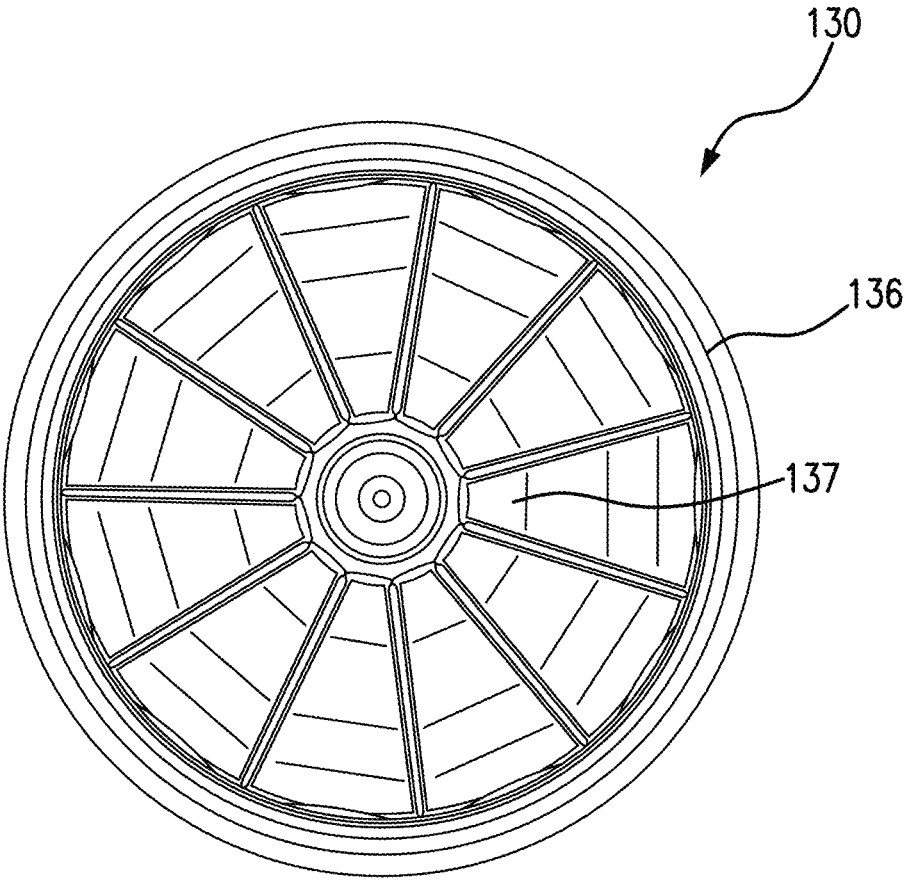
FIG. 7 is a bottom view of the plastic container illustrated in FIG. 1A.

The bottom portion 130, as illustrated in FIGS. 1A-1B, for example and not limitation, can include a cylindrical base wall 135, and a support surface 136 defining a reference plane. The support surface 136 extends radially inward from the cylindrical base wall 135, and is configured for standing the container on a generally plane surface. As depicted in FIGS. 1B, 4C, and 7, the bottom portion 130 further includes a variable dynamic base portion 137 extending inward from the support surface 136. The variable dynamic base 137 is configured to deflect in response to a pressure differential between the chamber and an exterior of the container body. A variety of suitable configurations can be used for the variable dynamic base in accordance with the disclosed subject matter, providing that the structure of the base is capable of accommodating at least a portion of the pressure differential resulting from expected conditions, such as during the processes of hot-filling, cooling and sealing. For example, and not limitation, U.S. Pat. No. 9,296,539 discloses a variable dynamic base that can be used in accordance with the disclosed subject matter, and the content of the forgoing patent is incorporated herein by reference in its entirety.

In accordance with the disclosed subject matter and as illustrated in FIG. 1A, for example and not limitation, the sidewall portion 120 includes and extends longitudinally between a lower circumferential groove ring 121 and an upper circumferential groove ring 122. As embodied herein, each of the lower and upper circumferential groove rings extends about an entire circumference of the container. The lower circumferential groove ring 121 and the upper circumferential groove ring 122 provides structural support to maintain the plastic bottle roughly round in the package.

Figure 2A:
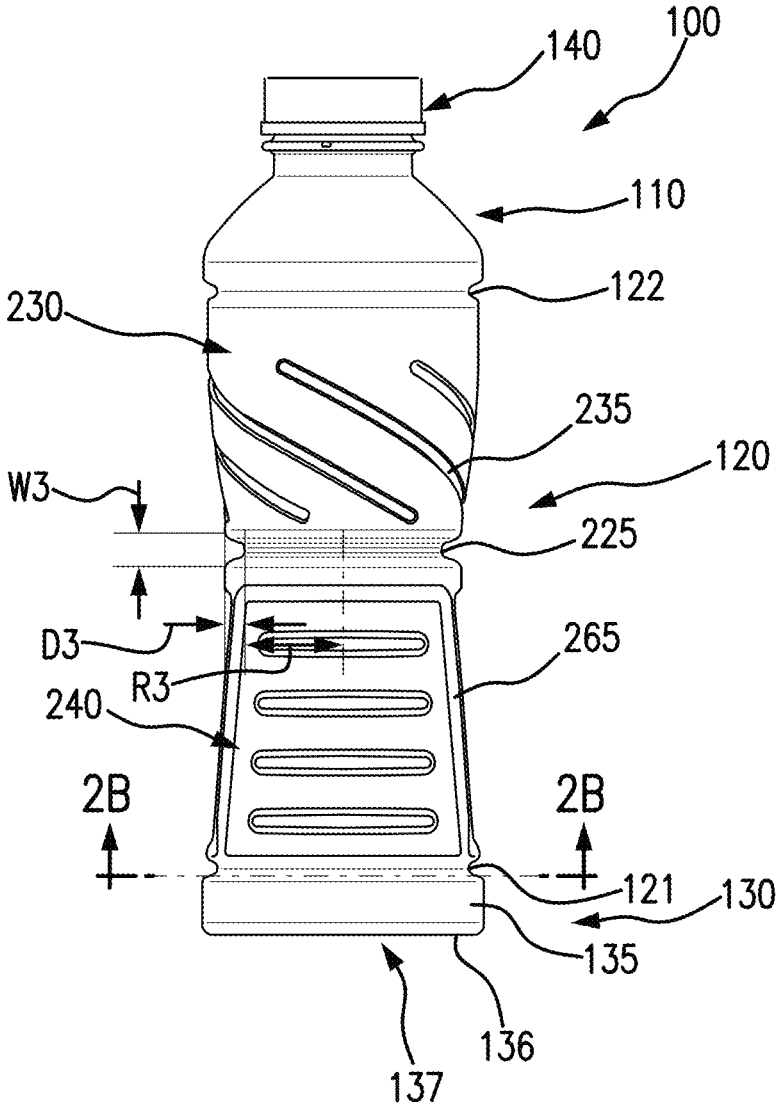
FIG. 2A is a rear view of the plastic container illustrated in FIG. 1A.
Figure 2B:
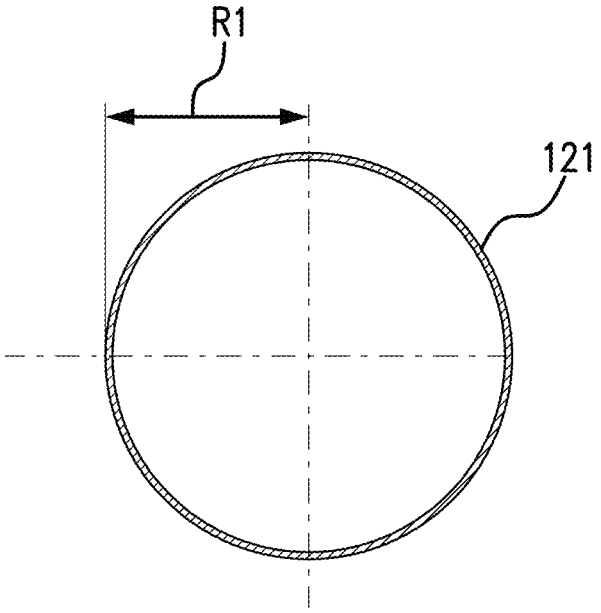
FIG. 2B is a cross-sectional plan view taken along the line 2B-2B in FIG. 2A.
Figure 5A:
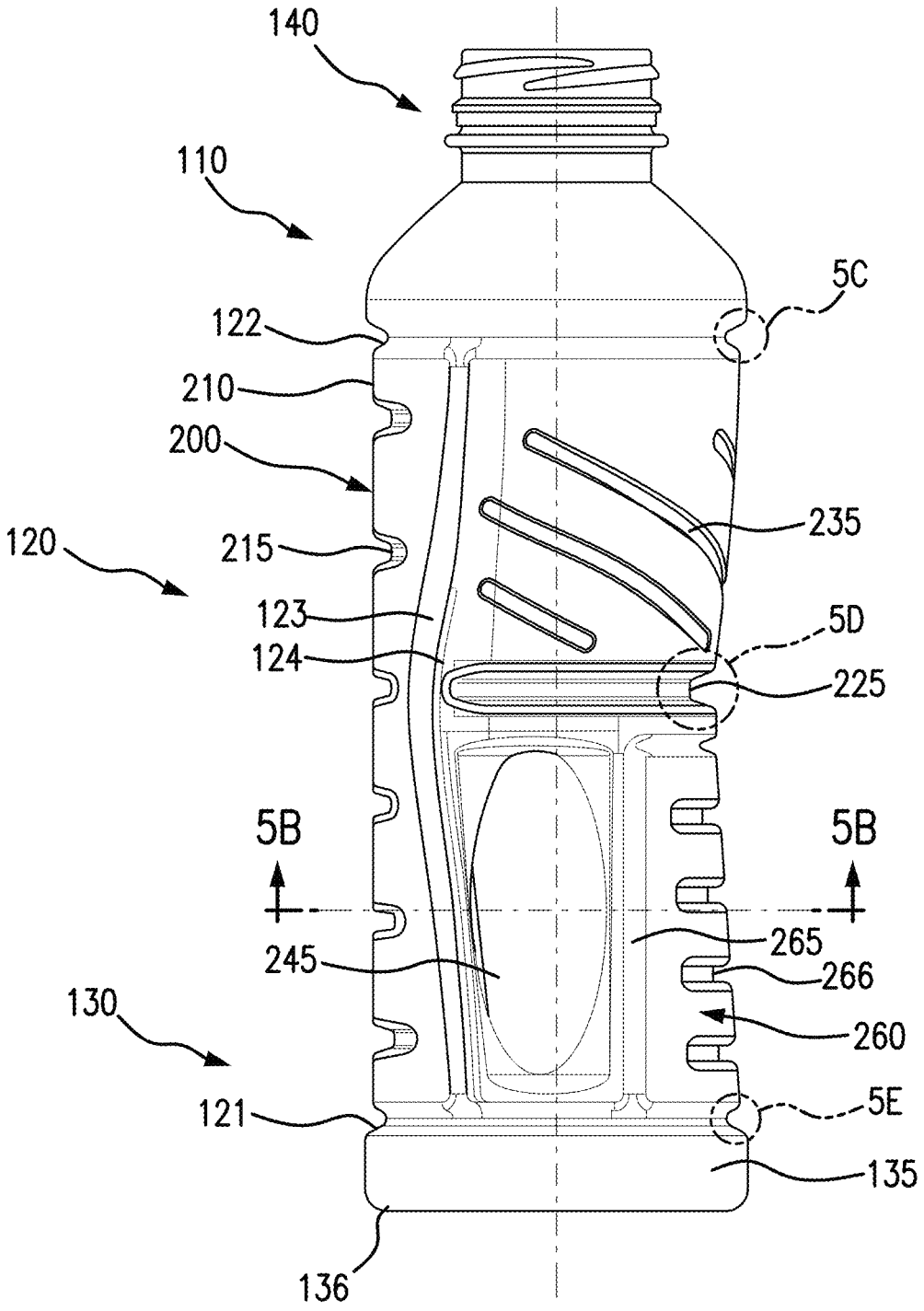
FIG. 5A is a right-side view of the plastic container illustrated in FIG. 1A
Figure 5B:
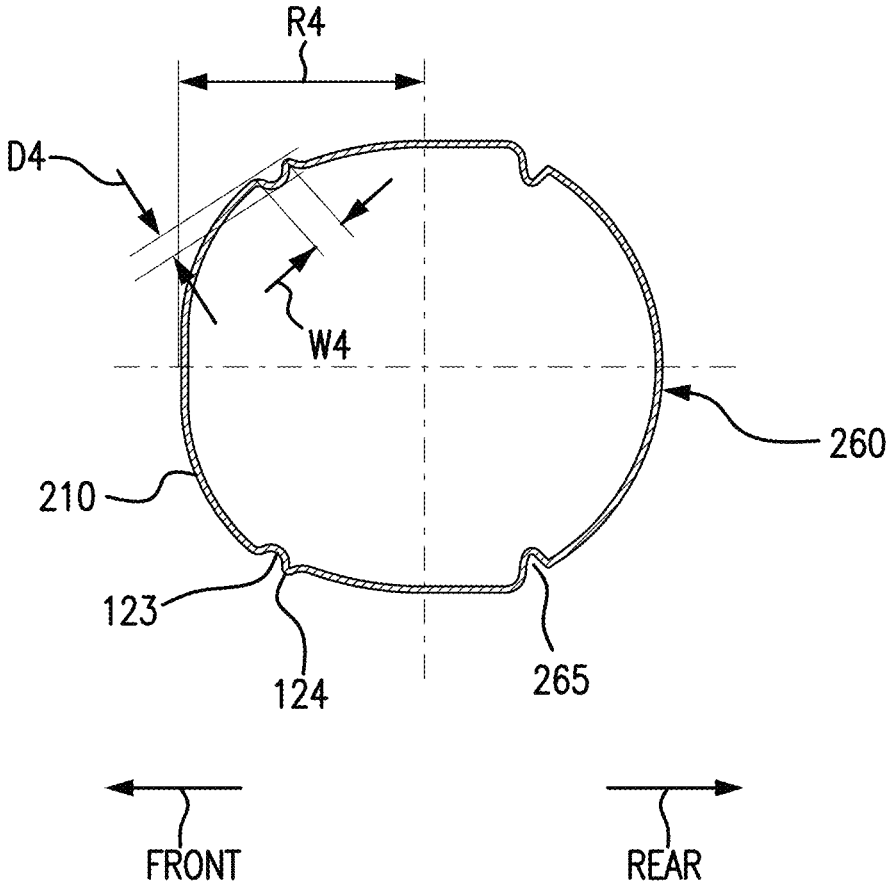
FIG. 5B is a cross-sectional plan view of the plastic container taken along the line 5B-5B in FIG. 5A.
Figure 5C:
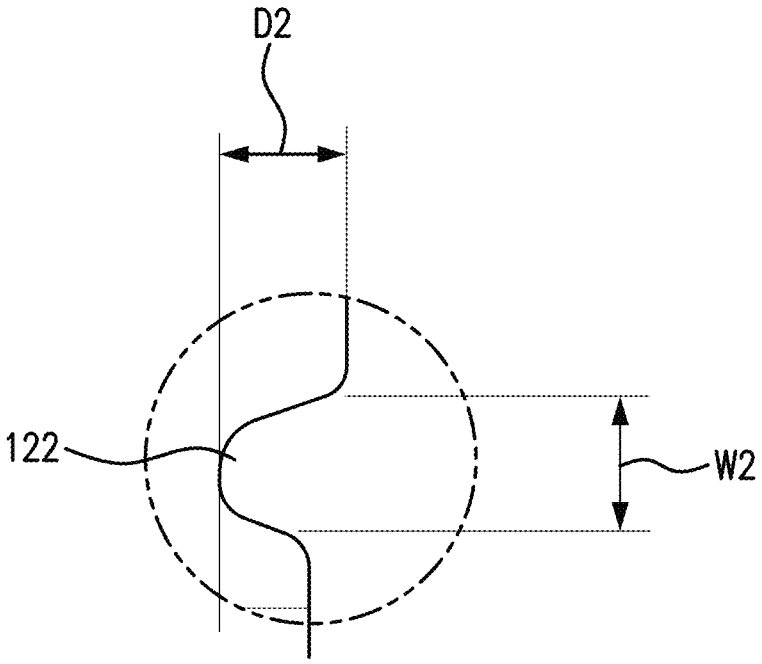
FIG. 5C is an enlarged detail view of the upper circumferential groove ring of FIG. 5A.
Figure 5D:
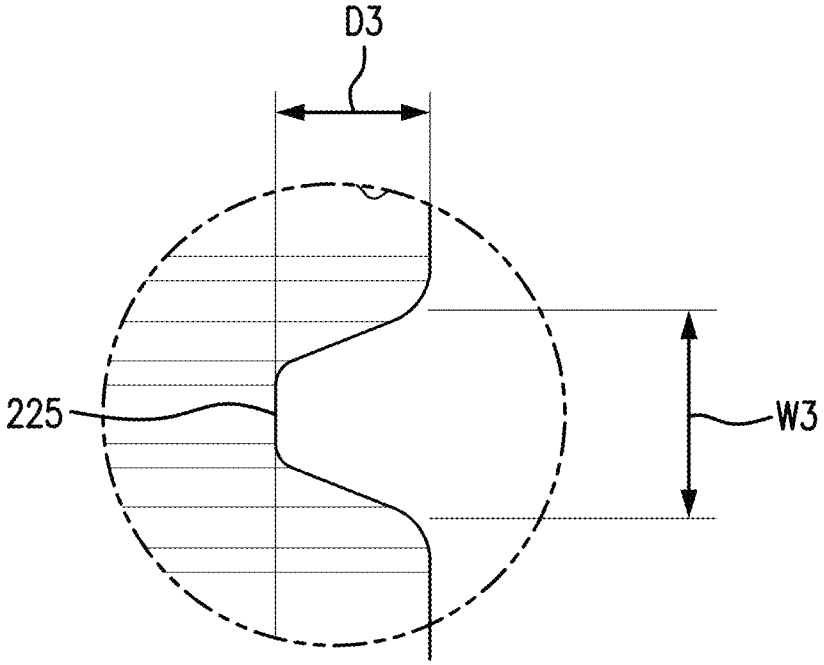
FIG. 5D is an enlarged detail view of the waist groove of FIG. 5A.
Figure 5E:
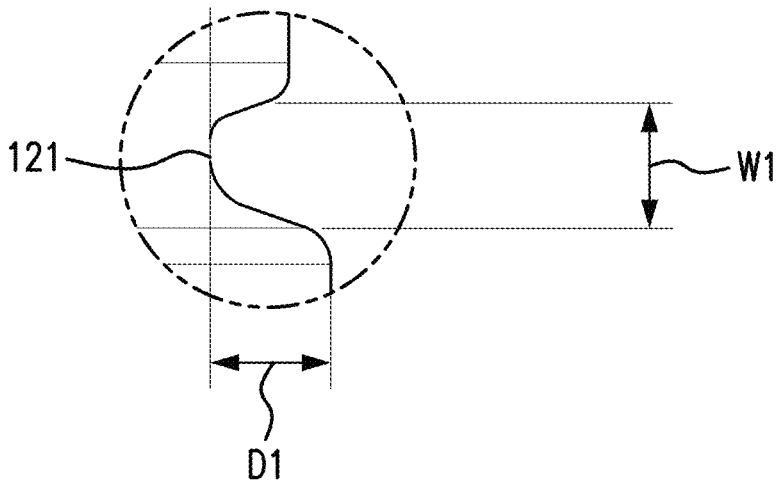
FIG. 5E is an enlarged detail view of the lower circumferential groove ring of FIG. 5A.

As illustrated in FIGS. 1A, 2B, and 5E, the lower circumferential groove ring 121 has a width W1 and a depth D1 in side view, each of which can be generally constant as embodied herein, and an outer radius R1 in plan view. Furthermore, and as best depicted in FIG. 5E, the outer radius R1 can be along the lower edge of the lower circumferential groove ring 121 and proximate the bottom portion 130 to define a bumper extending radially outward greater than the sidewall portion 120. In accordance with the disclosed subject matter, the ratio of the width W1 to the outer radius R1 can range between about 0.07 to about 0.22, and the ratio of the depth D1 to the outer radius R1 can range between about 0.04 to about 0.18.

As illustrated in FIGS. 1A and 5C, the upper circumferential groove ring 122 has a width W2 and a depth D2 in side view, each of which can be generally constant as embodied herein, and an outer radius R2 in plan view. Furthermore, and as best depicted in FIG. 5C, the outer radius R2 can be along the upper edge of the upper circumferential groove ring 122 and proximate the upper portion 110 to define a bumper extending radially outward greater than the sidewall portion 120. In accordance with the disclosed subject matter, the ratio of the width W2 to the outer radius R2 can range between about 0.07 to about 0.22, and the ratio of the depth D2 to the outer radius R2 can range between about 0.04 to about 0.18.

Exemplary dimensions of the lower circumferential groove ring 121 and upper circumferential groove ring 122 for an 18.5 oz container are reproduced in detail in Table 1 for purpose of illustration and not limitation.

Figure 3A:
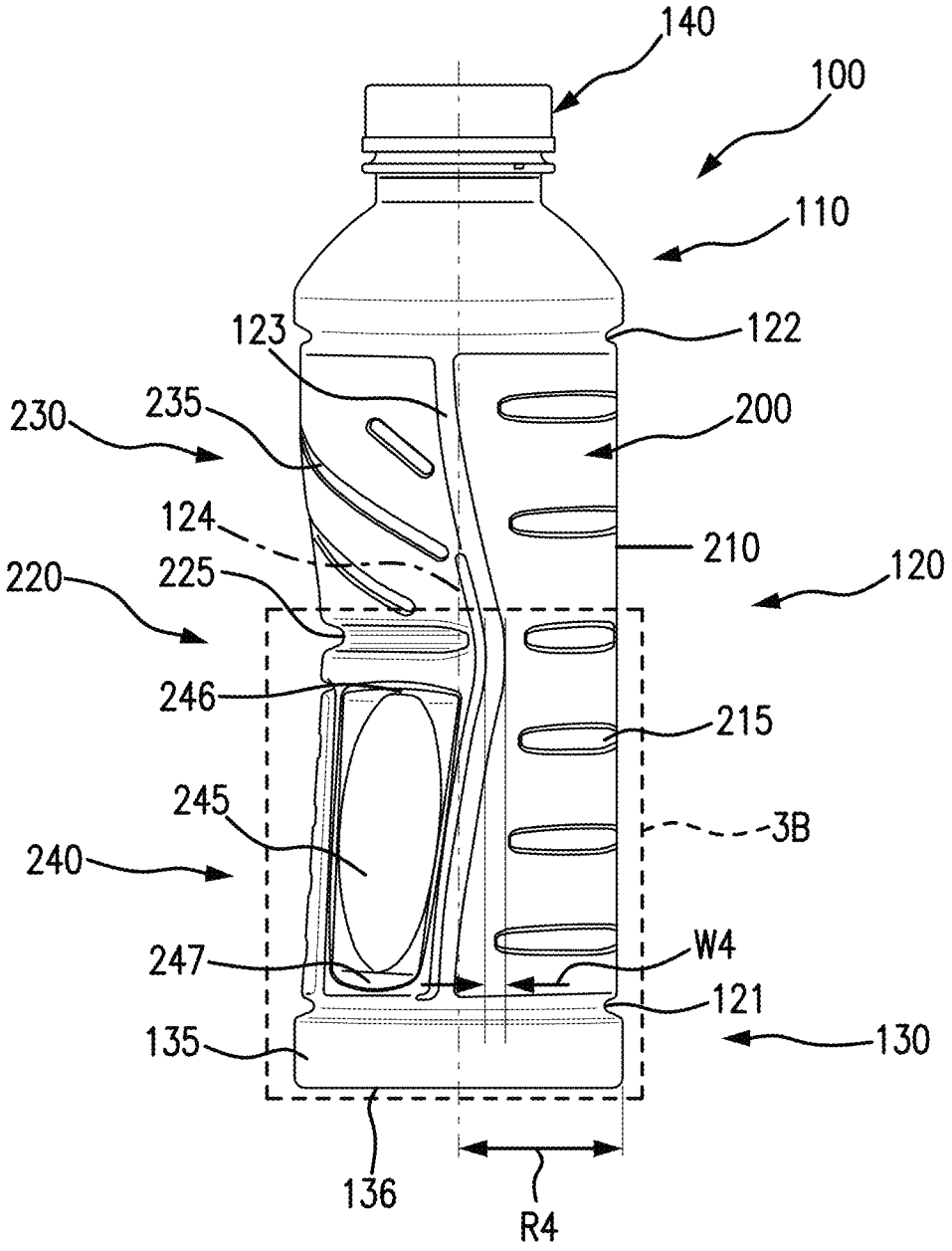
FIG. 3A is a left-side view of the plastic container illustrated in FIG. 1A.
Figure 3B:
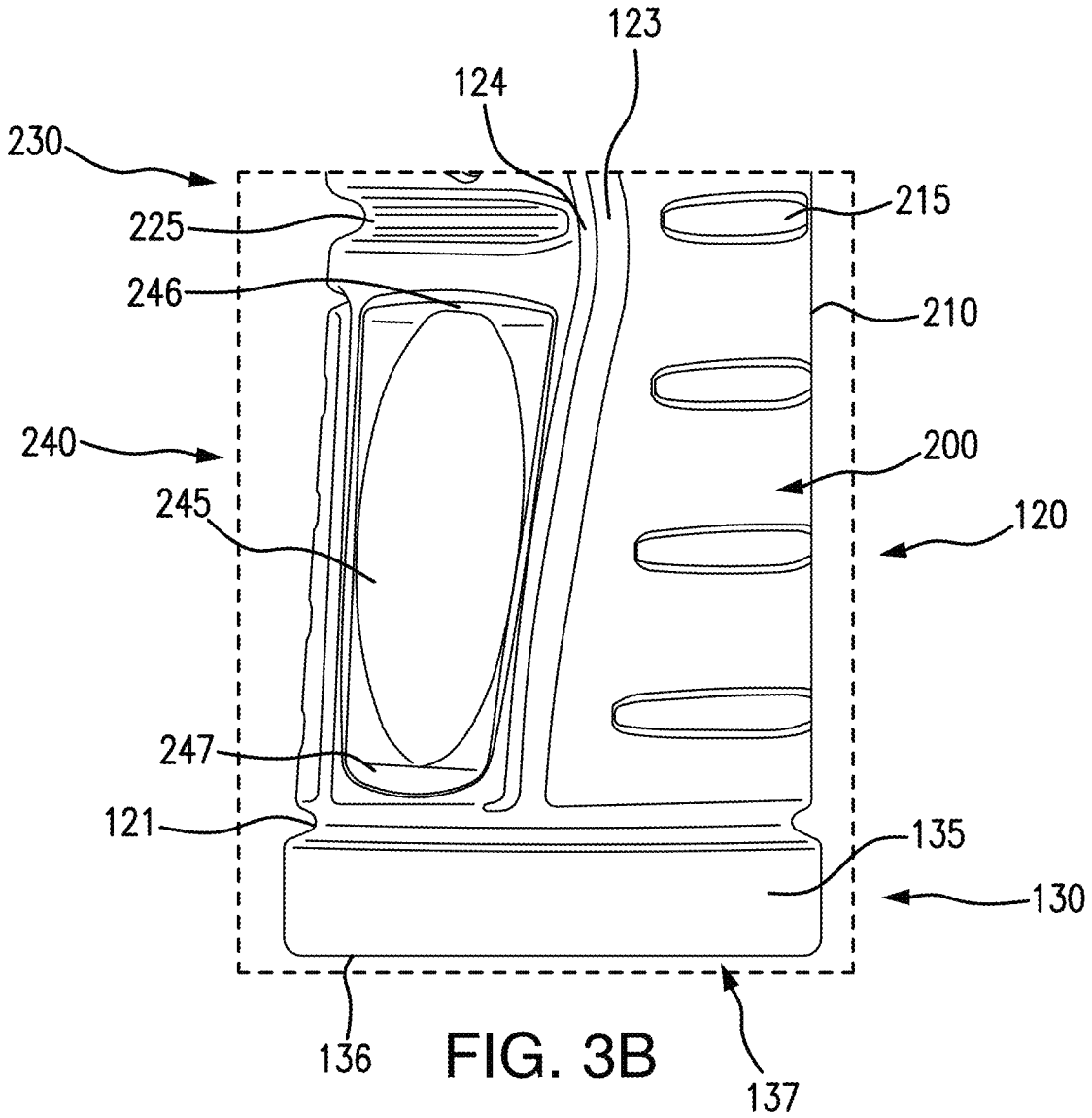
FIG. 3B is an enlarged detail view of the lower rear sidewall segment with vacuum panel and a portion of the lower front sidewall segment of FIG. 3A.

In accordance with another aspect of the disclosed subject matter, and as illustrated in FIGS. 3A and 5A, for example and not limitation, the sidewall portion 120 includes a pair of longitudinal grooves 123 extending longitudinally between the upper 122 and lower 121 circumferential groove rings to define a front sidewall segment 200 on a front side of the sidewall portion 120. Each of the longitudinal grooves 123 can extend into and connect with the lower circumferential groove ring 121 and the upper circumferential groove ring 122. As embodied herein, and as illustrated in FIG. 1A, the front sidewall segment 200 can be a front rigid panel 210 bordered by the lower circumferential groove ring 121, the upper circumferential groove ring 122 and the pair of longitudinal grooves 123. These grooves collectively thus structurally isolate the front rigid panel 210 from the rear sidewall segment 220 to protect the front rigid panel 210 from deformation during hot-filling processes. Furthermore, as illustrated in FIGS. 3A-3B and 5A, for example and not limitation, a stiffening bead 124 is provided along at least a portion of a length of each longitudinal groove 123 to isolate the waist groove 225 from the longitudinal grooves 123 and thus the rigid front panel 210. As embodied herein, for illustration and not limitation, the stiffening bead can extend from the lower end of the longitudinal groove 123 to about ⅔ height of the container body 100. For example, and illustrated in FIGS. 5A and 5B, the stiffening bead can be disposed along a rear edge of the longitudinal groove 123, physically separating the waist groove 225 from the longitudinal groove 123, as well as structurally reinforce the sidewall to prevent hinge-like movement proximate the waist groove 225.

In addition, as embodied herein and illustrated in FIG. 1A, the front rigid panel 210 can further include a plurality of circumferentially-extending ribs 215 to stiffen the panel area and provide additional protection against deformation during hot-filling and cooling processes. The front rigid panel 210, as embodied herein, is free of any vacuum panel or similar feature. The front rigid panel can have a constant radius in plan view, or as depicted and embodied herein, can flatten along its height.

Figure 1C:
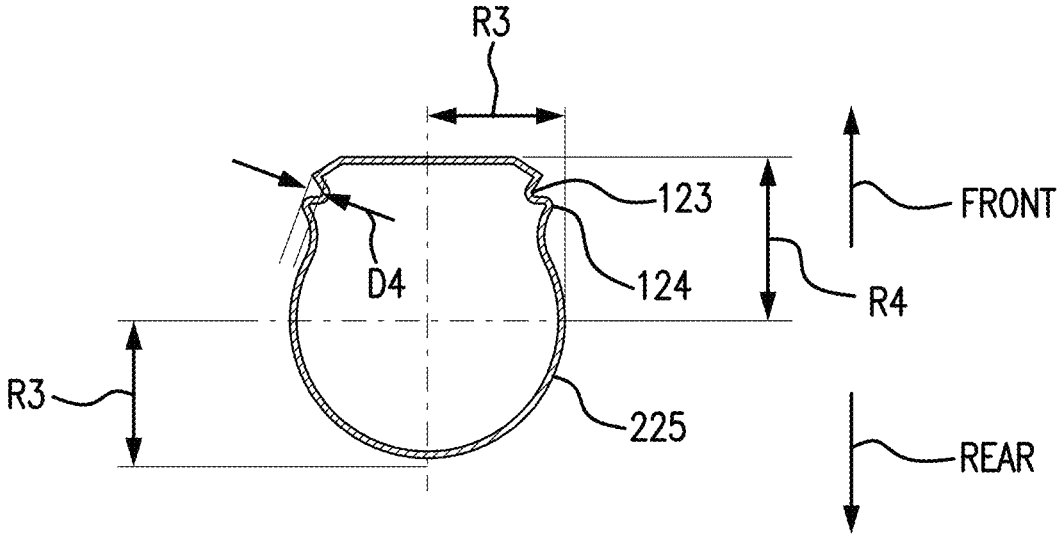
FIG. 1C is a cross-sectional plan view taken along the line 1C-1C in FIG. 1A.

As shown in FIGS. 1C, 3A, and 5B. the longitudinal groove can have a width W4 and a depth D4 in plan view, and the front sidewall segment can have an outer radius R4 in plan view. The width W4 and depth D4 can be varied along the length of each longitudinal groove. In accordance with the disclosed subject matter, the ratio of the width W4 to the outer radius R4 can range between about 0.07 to about 0.18, and the ratio of the depth D4 to the outer radius R4 can range between about 0.02 to about 0.14. For example and not limitation, the middle portion of the longitudinal groove can have a greater depth than the upper and lower portions of the longitudinal groove. The exemplary dimensions of the longitudinal groove 123 for an 18.5 oz container are reproduced in detail in Table 1 for purpose of illustration and not limitation.

The pair of longitudinal grooves 123 can be linear to define a generally rectangular panel. Additionally, as embodied herein and illustrated in FIGS. 1A, 3A, and 5A, for example and not limitation, the longitudinal grooves 123 can be nonlinear, such that the front sidewall segment 200, which is defined along opposing sides by each of the longitudinal grooves 123, can be configured with an contoured shape for labeling, aesthetic or ergonomics needs of the disclosed subject matter. As illustrated, for example and not limitation, in FIG. 1A, the front sidewall segment 200 can have a bow-tie shape defined between a pair of nonlinear longitudinal grooves 123. The bow-tie shape front sidewall segment 220 embodied herein thus has a maximum circumferential width proximate each of the lower 121 and upper 122 circumferential groove rings and a minimum circumferential width aligned longitudinally along a height of the sidewall portion with the waist groove 225.

In accordance with another aspect of the disclosed subject matter, and as illustrated in FIGS. 2A, 3A, 4A, 5A, and 6, for example and not limitation, the sidewall portion 120 further includes a rear sidewall segment 220 on a rear side of the sidewall portion 120 between the upper 122 and lower 121 circumferential groove rings, and is defined by the pair of longitudinal grooves 123. As illustrated in FIGS. 2A, 3A, 3B, 4A, 4B, 5A, and 6, for example and not limitation, the rear sidewall segment 220 comprises a waist groove 225 extending circumferentially between the pair of longitudinal groove 123. As embodied herein, the waist groove 225 can extend about a circumference of between about 65% to about 75% of a diameter of the waist groove 225, thus providing a strong structural rigidity for rear sidewall segment 220. As illustrated in FIGS. 1C, 2A, and 5D, the waist groove has a width W3 and depth D3 in side view, each of which can be generally constant as embodied herein, and an inside radius R3 in plan view. In accordance with the disclosed subject matter, the ratio of the width W3 to the inside radius R3 can range between about 0.15 to about 0.46, and the ratio of the depth D3 to the inside radius R3 can be about 0.10 to about 0.30. The exemplary dimensions of the waist groove 225 are reproduced in detail in Table 1 for an 18.5 oz container, for purpose of illustration and not limitation.

In accordance with another aspect of the disclosed subject matter, and as illustrated in FIG. 2A, for example not limitation, the rear sidewall segment 220 comprises a lower rear sidewall segment 240 defined between the waist groove 225 and the lower circumferential groove ring 121, and an upper rear sidewall. One of the lower rear sidewall segment 240 or the upper rear sidewall segment 230 includes at least one vacuum panel 245 configured to deflect in response to the pressure differential between the chamber and the exterior of the container body. A variety of suitable configurations can be used for the vacuum panel in accordance with the disclosed subject matter. For example, and not limitation, U.S. Pat. No. 5,971,184 discloses a vacuum panel that can be used in accordance with the disclosed subject matter, and the content of the forgoing patent is incorporated herein by reference in its entirety.

Figure 4D:
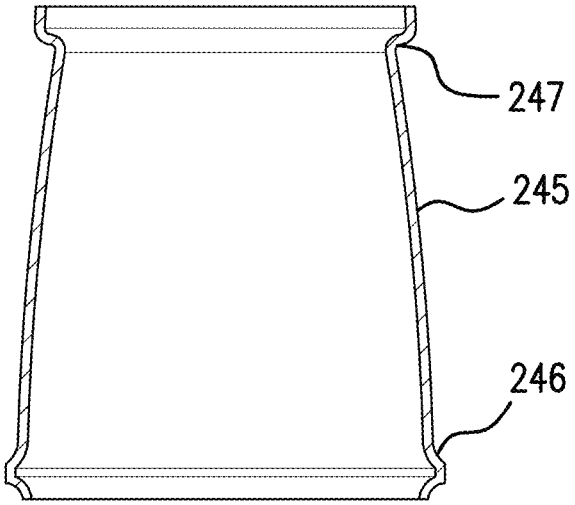
FIG. 4D is a cross-sectional side view of each vacuum panel taken along the line 4D-4D in FIG. 4A.

As embodied herein, the lower rear sidewall segment 240 can include the at least one vacuum panel 245. As illustrated, for example and not limitation, in FIGS. 3A, 3B, 4A, 4B, 5A, and 6, the lower rear sidewall segment 240 includes two vacuum panels 245. The vacuum panels and the variable dynamic base together are sized and configured to compensate for a desired range of pressure differentials. As further embodied herein, for additional strength and rigidity, each vacuum panel is angled inwardly toward the chamber relative to a vertical reference plane perpendicular to the support surface 136. For example and as depicted in FIGS. 4A, 4B, and 4D, each vacuum panel 245 is recessed relative an outer surface of the rear sidewall segment 220. A depth of the recess along an upper edge of the vacuum panel, i.e. the upper recessed depth 246, is greater than a depth of the recess along a lower edge of the vacuum panel, i.e. the lower recessed depth 247.

As embodied herein and illustrated in FIGS. 4A and 4B, for example and not limitation, the lower rear sidewall segment 240 further includes a rigid longitudinal support between the two vacuum panels 245. The rigid longitudinal support can be a column feature or other suitable configurations. As illustrated in FIG. 2A, for example and not limitation, the longitudinal support is a rigid support panel 260, which can be free of any vacuum panel. A border groove 265, as shown in FIGS. 4A-4B and 5A-5B, is provided along an edge of the rigid support panel 260. As embodied herein, the border groove 265 can extend into and connect with the lower circumferential groove ring 121. The border groove 265 together with the lower circumferential grooving ring 121 thus surround the rigid support panel 260 to isolate it from other portions of the container, further structurally protecting the rigid support panel 260 from deformation associated with the hot-filling and cooling processes. Additionally, and as embodied herein, the rigid support panel 260 can include a plurality of circumferentially-extending ribs 266 to stiffen the rigid support panel and provide additional protection against deformation associated with the hot-filling processes. As illustrated in FIG. 2A, for example and not limitation, the rigid support panel 260 can have a partial frustoconical shape, so as to taper inwardly toward the waist groove 225.

Figure 6:
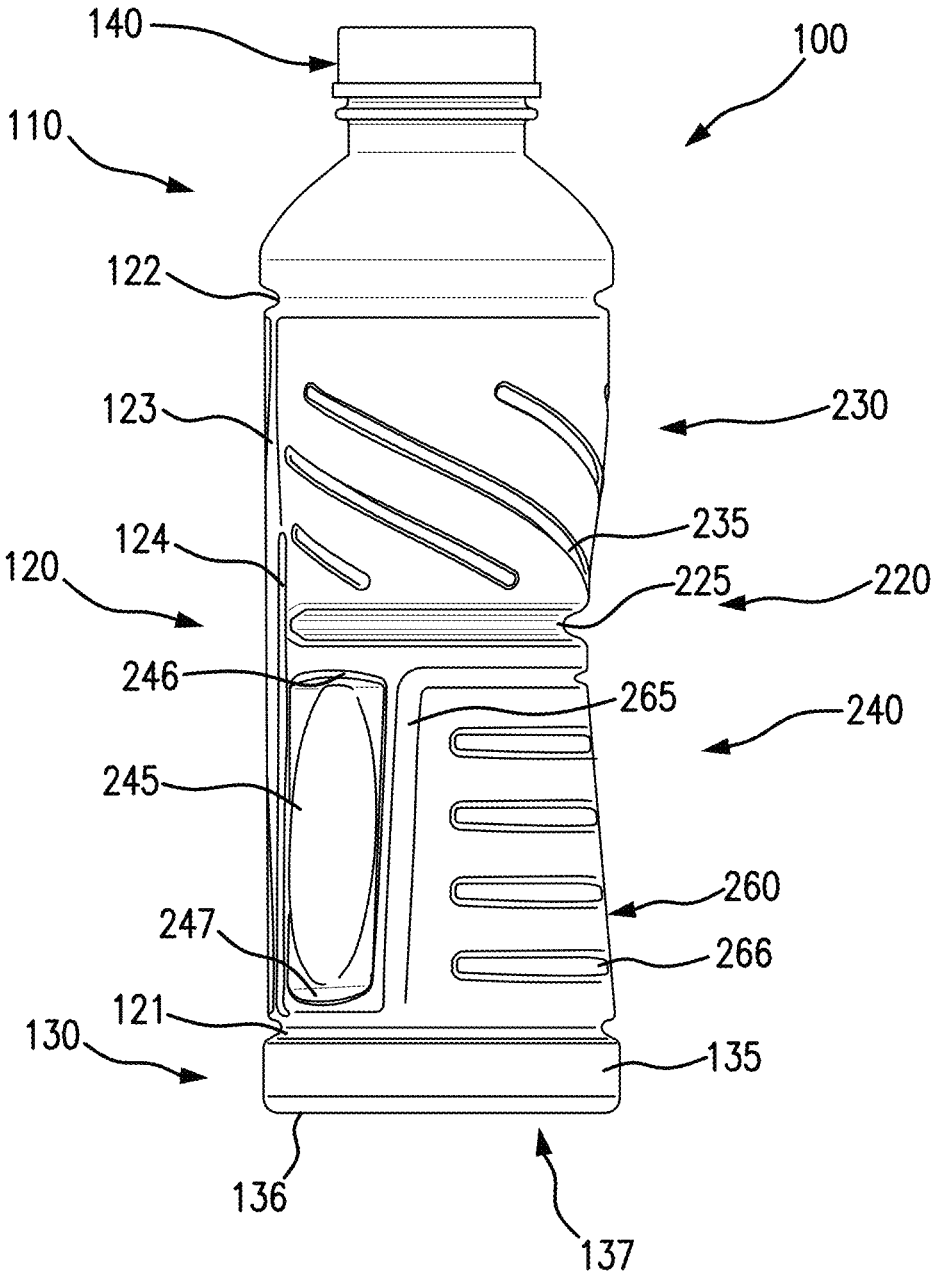
FIG. 6 is a rear-right side view of the plastic container illustrated in FIG. 1A.

As embodied herein, the rear sidewall segment 220 also comprises an upper rear sidewall segment 230 defined between the waist groove 225 and the upper circumferential groove ring 122. As illustrated in FIGS. 3A, 5A, and 6, for example not limitation, the upper rear sidewall segment 230 is bordered by and thus isolated from other portions of the plastic container by the waist groove 225, the upper circumferential groove ring 122 and the pair of longitudinal grooves 123 so as to be structurally protected from deformation during hot-filling and cooling processes. As embodied herein and illustrated in FIGS. 2A, for example not limitation, the upper rear sidewall 230 can include a plurality of angled ribs 235 for stiffening and/or aesthetic purposes, providing additional structural protection to the upper rear sidewall segment 230. As illustrated, for example and not limitation, in FIGS. 1B, 2A, and 5A, the upper rear sidewall segment 230 has a partial bowl shape so as to taper inwardly towards the waist groove 225.

For purpose of illustration and not limitation, reference is now made to an exemplary container in accordance with the disclosed subject matter. The exemplary container is configured to contain approximately 18.5 oz of fluid, and has an overall height of about 8.4 inches and overall maximum diameter at its base of about 2.77 inches. For convenience and illustration, the dimensions of such container for the lower circumferential groove ring 121 depicted in FIGS. 1A and 5E, the upper circumferential groove ring 122 depicted in FIGS. 1A and 5C, the waist groove 225 depicted in FIGS. 2A and 5D, and the longitudinal groove 123 depicted in FIGS. 3A and 5B, are reproduced in Table 1 below.

TABLE 1

Exemplary dimensions of lower and upper circumferential groove rings, waist groove, and longitudinal groove.

| | Example (inch) | Preferred Range (inch) |
|---|---|---|
| Lower circumferential groove ring 121 | | |
| Width (W1) | 0.153 | 0.100-0.300 |
| Depth (D1) | 0.147 | 0.050-0.250 |
| Outer Radius (R1) | 1.383 | 1.125-2.500 |
| Upper circumferential groove ring 122 | | |
| Width (W2) | 0.152 | 0.100-0.300 |
| Depth (D2) | 0.142 | 0.050-0.250 |
| Outer Radius (R2) | 1.378 | 1.125-2.500 |
| Waist groove 225 | | |
| Width (W3) | 0.254 | 0.150-0.450 |
| Depth (D3) | 0.187 | 0.100-0.300 |
| Inside Radius (R3) | 0.970 | 0.750-2.000 |
| Longitudinal groove 123 | | |
| Width (W4) of lower portion of longitudinal groove 123 | 0.134 | 0.100-0.250 |
| Width (W4) of middle portion of longitudinal groove 123 | 0.178 | 0.100-0.250 |
| Width (W4) of upper portion of longitudinal groove 123 | 0.154 | 0.100-0.250 |
| Depth (D4) of lower portion of longitudinal groove 123 | 0.050 | 0.025-0.200 |
| Depth (D4) of middle portion of longitudinal groove 123 | 0.156 | 0.025-0.200 |
| Depth (D4) of upper portion of longitudinal groove 123 | 0.052 | 0.025-0.200 |
| Outer Radius (R4) | 1.383 | 1.125-2.500 |

As embodied herein, and for purpose of illustration and not limitation, the plastic containers disclosed herein can be formed using any suitable method as known in the art. For example, the plastic containers can be blow molded from an injection molded preform made from, for example, PET, PEN or blends thereof, or can be extrusion blow molded plastic, for example, polypropylene (PP). The finishes of the containers can be injection molded, i.e. the threaded portion can be formed as part of the preform, or can be blow molded and severed from an accommodation feature formed thereabove, as is known in the art.

Figure 8A:
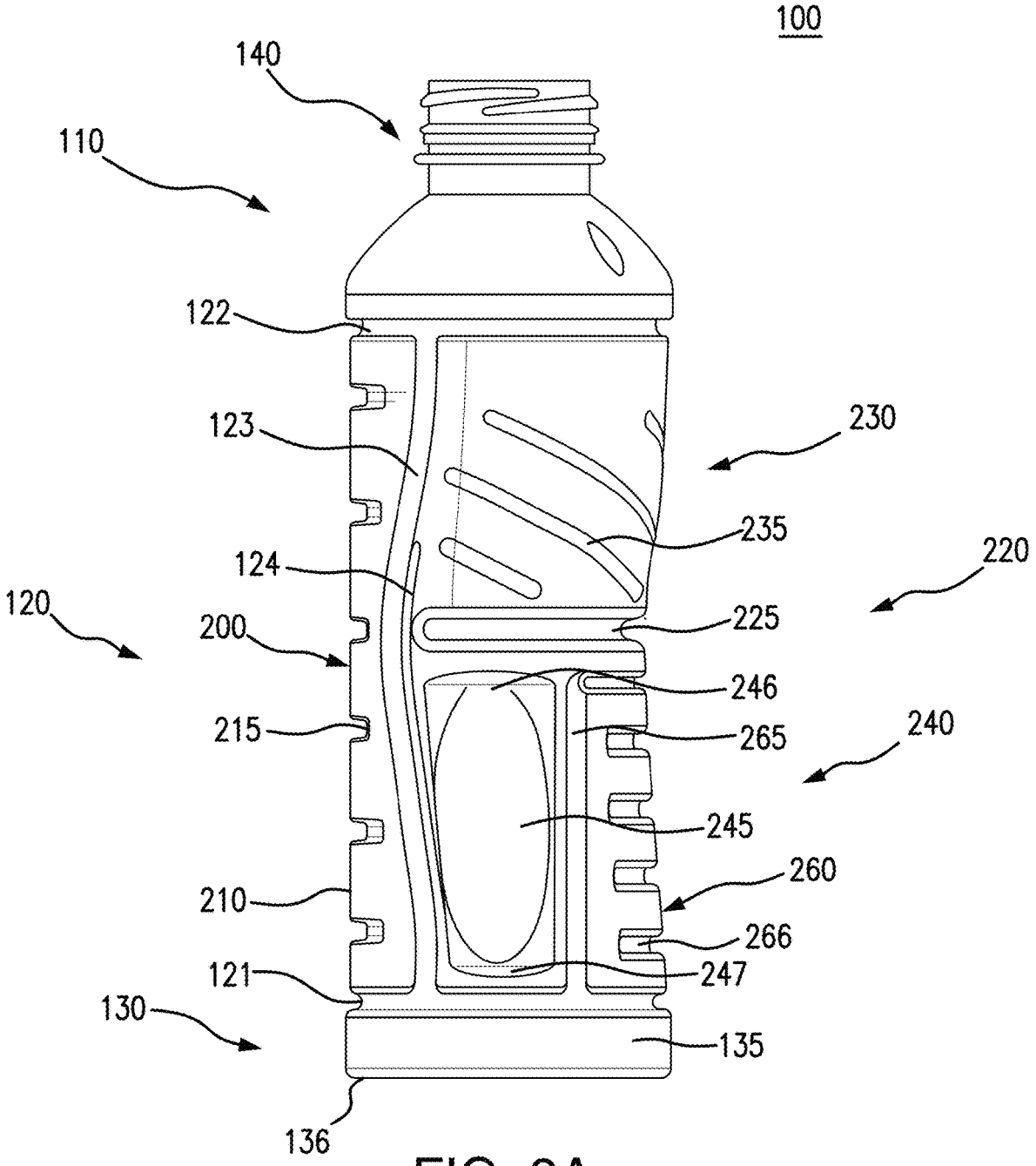
Figure 8B:
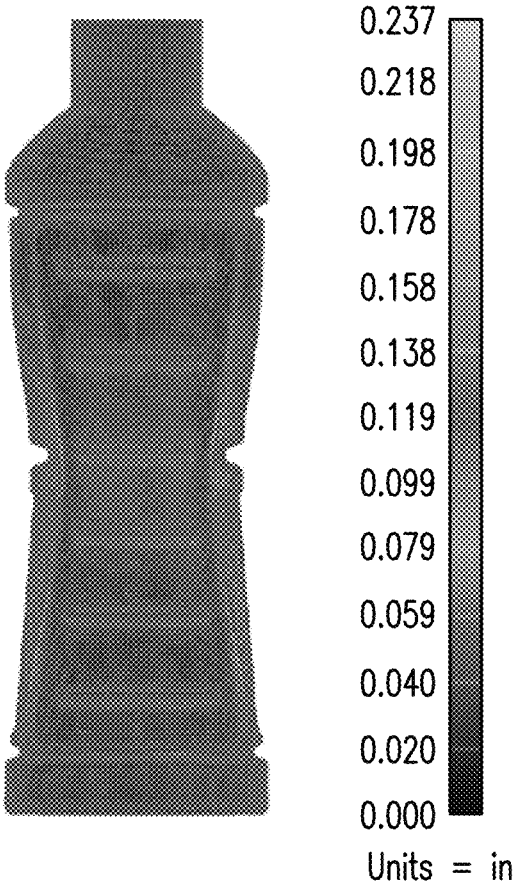
Figure 8C:
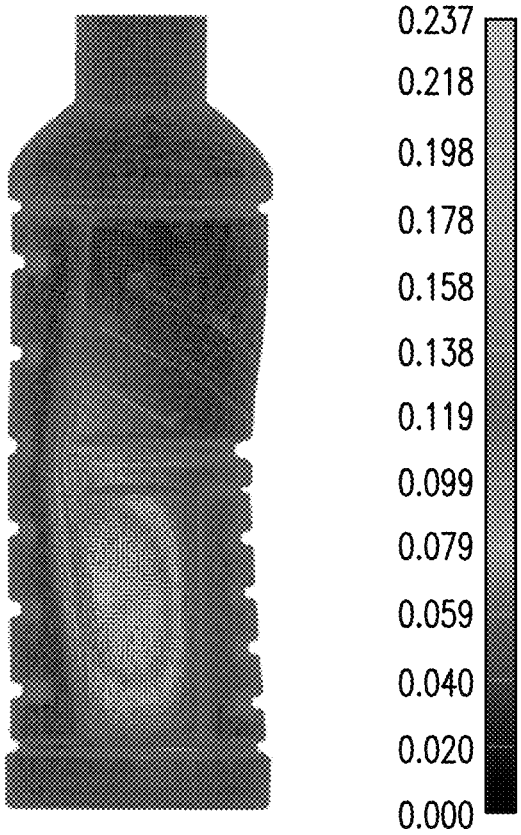
Figure 8D:
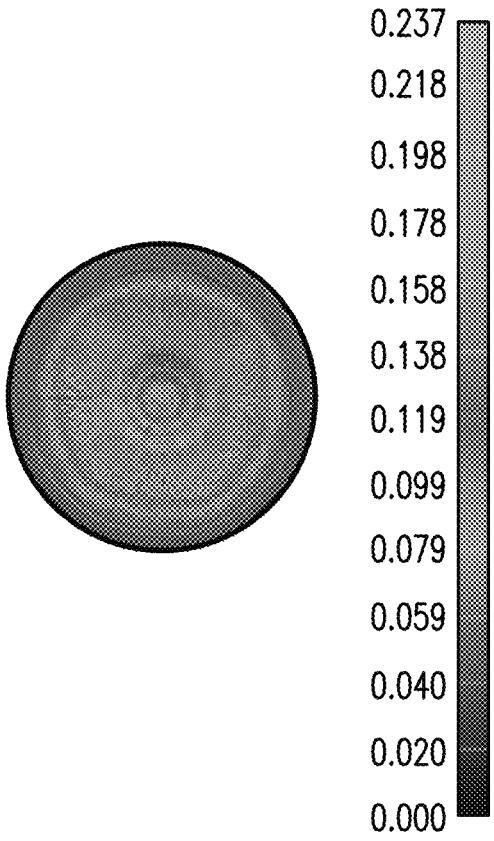

FIG. 8A illustrates, for example and not limitation, an embodiment of the hot-fillable plastic container of FIG. 1A in accordance with the disclosed subject matter. Referring to FIGS. 8B-8D, a computerized method of finite element analysis was performed on a plastic container depicted in FIG. 8A, to demonstrate the reaction of the container to an extending pressure differential of hot-fill and cooling processes. The finite element analysis was performed by exposing a blow mold simulation to a suitable pressure to achieve 24 cc of extraction, and an 18.5 oz model as described above was used. FIGS. 8B-8D graphically depict calculated deformation formed at various segments of the plastic container as a result of a conventional hot-filling process. It is noted that the front sidewall segment 210 as depicted in FIG. 8B, and the rigid support panel 260 and the upper rear sidewall segment 230 as depicted in FIG. 8C, resist substantially all deformation under vacuum, whereas substantially all deformation or compensation occurs within the vacuum panel 245 as depicted in FIG. 8B and the variable dynamic base 135 as depicted in FIG. 8C.

These results indicate that the overall configuration of the disclosed subject matter enables the plastic containers disclosed herein to accommodate different thermal and pressure differential scenarios associated with hot-filling processes, to control and eliminate unwanted deformation, making the package both visually appealing and functional for downstream situations While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the devices of the disclosed subject matter without departing from the spirit or scope of the disclosed subject matter. Thus, it is intended that the disclosed subject matter include modifications and variations that are within the scope of the appended claims and their equivalents.

What is claimed is:

1. An asymmetrical hot fillable plastic container comprising:

a container body comprising a bottom portion, a sidewall portion and an upper portion, the container body having a chamber defined therein, the container body further comprising a finish portion extending from the upper portion and defining a mouth in fluid communication with the chamber;

the bottom portion including a support surface and a variable dynamic base portion extending inward from the support surface configured to deflect in response to a pressure differential between the chamber and an exterior of the container body;

the sidewall portion including a lower circumferential groove ring and an upper circumferential groove ring, wherein the lower circumferential groove ring has a width W1 and a depth D1 in side view, and an outer radius R1 in plan view, a ratio of the width W1 to the outer radius R1 ranging between 0.07 to 0.22, and a ratio of the depth D1 to the outer radius R1 ranging between 0.04 to 0.18, wherein the upper circumferential groove ring has a width W2 and a depth D2 in side view, and an outer radius R2 in plan view, a ratio of the width W2 to the outer radius R2 ranging between 0.07 to 0.22, and a ratio of the depth D2 to the outer radius R2 ranging between 0.04 and 0.18, and wherein the sidewall portion includes a plurality of vacuum panels, each vacuum panel configured to deflect in response to the pressure differential between the chamber and an exterior of the container body; and a front sidewall segment of the sidewall portion has a front sidewall configuration, wherein the front sidewall configuration is different than a rear sidewall configuration of the sidewall portion.

2. An asymmetrical hot fillable plastic container comprising:

a container body comprising a bottom portion, a sidewall portion and an upper portion, the container body having a chamber defined therein, the container body further comprising a finish portion extending from the upper portion and defining a mouth in fluid communication with the chamber;

the sidewall portion including a lower circumferential groove ring and an upper circumferential groove ring, wherein the lower circumferential groove ring has a width W1 and a depth D1 in side view, and an outer radius R1 in plan view, a ratio of the width W1 to the outer radius R1 ranging between 0.07 to 0.22, and a ratio of the depth D1 to the outer radius R1 ranging between 0.04 to 0.18, wherein the upper circumferential groove ring has a width W2 and a depth D2 in side view, and an outer radius R2 in plan view, a ratio of the width W2 to the outer radius R2 ranging between 0.07 to 0.22, and a ratio of the depth D2 to the outer radius R2 ranging between 0.04 to 0.18, the sidewall portion further including a pair of longitudinal grooves extending longitudinally between the lower and upper circumferential groove rings to define a front sidewall segment on a front side of the sidewall portion between the upper and lower circumferential groove rings and a rear sidewall segment on a rear side of the sidewall portion between the upper and lower circumferential groove rings, wherein the rear sidewall segment includes a plurality of vacuum panels and a rigid longitudinal support between two of the vacuum panels, each vacuum panel configured to deflect in response to a pressure differential between the chamber and an exterior of the container body; and wherein the front sidewall segment has a constant radius in plan view to define a front rigid panel free of vacuum panels.

* * * * *